US005127654A

United States Patent [19]

Thackrey

[11] Patent Number: 5,127,654

[45] Date of Patent: Jul. 7, 1992

[54] GOLF CLUBHEAD TARGET

[76] Inventor: James D. Thackrey, 13852 Dall La., Santa Ana, Calif. 92705

[21] Appl. No.: 807,215

[22] Filed: Dec. 16, 1991

[51] Int. Cl.[5] ..... A63B 69/36

[52] U.S. Cl. ..... 273/186 R; 273/200 B

[58] Field of Search ..... 273/186 R, 186 A, 186 B, 273/186 C, 186 D, 186 E, 191 R, 191 A, 191 B, 192, 183 A, 183 E, 187 R, 200 R, 200 B, 197 R

[56] References Cited

U.S. PATENT DOCUMENTS 3,020,049 2/1962 McNeill ..... 273/186 RA
3,246,898 4/1966 Shoaf ..... 273/191 R X
3,386,733 6/1968 Russo et al. ..... 273/186 R
3,895,366 7/1975 Morris ..... 340/207 R
4,155,555 5/1979 Fink ..... 273/186 R
4,223,891 9/1980 Van Gaasbeek et al. ..... 273/186 R

*Primary Examiner*—George J. Marlo

[57] ABSTRACT

A stationary, ground level target having an opening giving controlled clearance for the head of a set of golf clubs. Made of thin metal easily bent so as to see from the damaged target where it has been hit, or of flexible plastic so as to spare clubhead finish, both versions have a flat mock ball on the downswing side for aiming; the clubhead passes under the simulated ball which is located directly above the sweet spot path. An optimal platform contains a slot to hold the target for indoor practice; the target can also be placed upright in the ground.

4 Claims, 1 Drawing Sheet

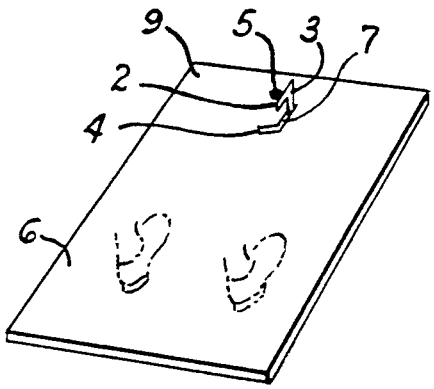
Fig. 1
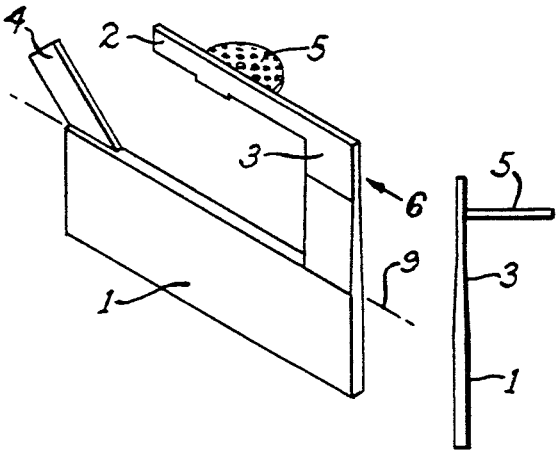
Fig. 5
Fig. 6
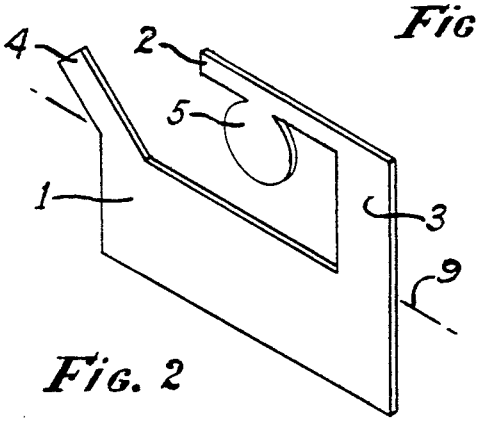
Fig. 2
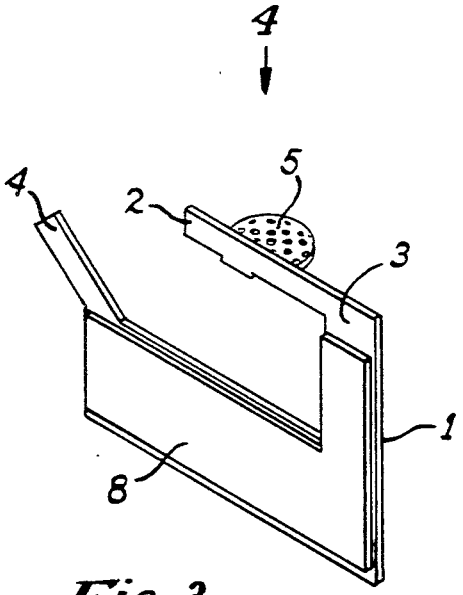
Fig. 3
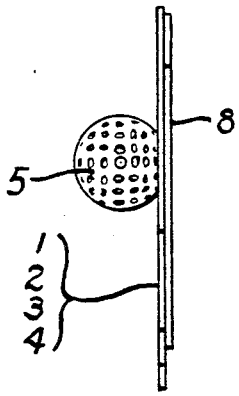
Fig. 4

GOLF CLUBHEAD TARGET

BACKGROUND OF THE INVENTION

1. Field of the Invention

The invention is in the field of golf practice devices.

2. Description of Prior Art

Numerous devices of all kinds have been devised for golfers to improve their skill at the game through practice. These include electronic devices for measuring clubhead speed and face angle, devices for inducing an ideal swing arc, tethered balls, and practice nets among others. Improvement of the putting stroke has fostered a great many simulated cups and target-type devices; these are a great help in that they can be used indoors.

Clubhead angularity during a full swing or stroke is determined by Pelz (U.S. Pat. No. 4,251,077) and Mackniesh (U.S. Pat. No. 3,194,563) employing mirrors. Streaks of light are generated by a special clubhead of Worrell (U.S. Pat. No. 3,649,028). Toe path relative to that desired to make contact at the sweet spot is determined by photocells by Fink (U.S. Pat. No. 4,155,555), and heel and toe photocells are used by McNeill (U.S. Pat. No. 3,020,049). Elastomeric feelers protruding through a special mat actuate switches in Von Gaasbeek et al (U.S. Pat. No. 4,223,891). A markable target pasted over the sweet spot is used by Grossman (U.S. Pat. No. 2,660,436). All these devices detect the toe, heel, or sweet spot position as the clubhead impacts the ball or simulated ball. Only Grossman's target also detects whether the sole of the clubhead is above ground level at impact; the ground itself telling whether the sole is below ground level.

Although to a golfer information as to clubface angles in both horizontal and vertical planes are important, as well as clubhead velocity, the two most important pieces of information are where the impact point is along the clubface heel to toe and sole to top. My invention, a target with an opening serving as "bullseye" provides a go-no go test of adequacy in this respect. When the stroke is no-go or inadequate, examination of the damaged target discloses which area was hit by the clubhead. The simplicity of the invention, its low cost and easy setup also constitute improvements over the prior art as known by me.

SUMMARY OF THE INVENTION

An easily bendable sheet metal or plastic frame surrounds an opening through which a family (assortment) of golf clubheads can pass with say three-sixteenths to five-sixteenths of an inch clearance (depending on which clubhead) all around. Clearance over the club shaft, which passes through a break in the frame, is larger. As manufactured a simulated golf ball depends from the frame member opposite the club sole at the nominal sweet spot of the clubheads into the opening; in use the simulated golf ball is bent 90 degrees out of the plane of the frame. The width of frame members (borders) varies, those adjacent clubhead top and shank are narrow so as to be easily bent, the width adjacent the toe is wider and the width of the frame member adjacent the sole is substantial as it, though all buried in the ground or simulated ground, serves to hold the frame upright in a vertical plane. The simulated ball, bent left or right as the user prefers, is horizontal at a height just above the sweet spot of a properly swing clubhead. The "bullseye" of the target is open air. When the swing is imperfect and strikes the frame (also designated border), the portion struck can be determined from examining the bent target before restraightening, which can be accomplished with the fingers since the material is thin and selected to withstand work hardening.

The same opening and clearance distance can be provided in a flexible plastic target which flexes rather than bends; the differing properties of this alternate version are discussed later.

Control of the clubhead position at impact being absolutely primary to a good golf game, but neglected in favor of slice control, distance etc. by many golfers, it is expected that this invention will be useful to teach how hard a golfer can swing without losing control.

BRIEF DESCRIPTION OF THE DRAWINGS

FIG. 1 shows a perspective view of an indoor practice apparatus using the invention.

FIG. 2 is a perspective view of the invention as manufactured and shipped.

FIG. 3 is a perspective view of the preferred embodiment as it would be prior to inserting in the ground or simulated ground.

FIG. 4 is a plan view of the invention as seen by a golfer in the process of using it.

FIG. 5 is a perspective view of the alternate embodiment in flexible plastic.

FIG. 6 is an end view of either an extrusion from which FIG. 5 is cut, or the finished plastic version of a target.

DETAILED DESCRIPTION OF THE PREFERRED EMBODIMENT

As shown in FIG. 2, a thin sheet of easily bent material (metal or plastic) is pierced to create an opening based on the shape of a golf clubhead shadow projected by horizontal light onto a vertical plane. The clubhead's shadow outline is moved a clearance distance, say a quarter inch in all directions, to establish a tentative outline of the shape to be pierced. Two further steps finalize the shape. In one of these all irons and fairway woods in the family of clubs for which the target is to be used, are shadow-checked and the shape adjusted to clear them all by say 3/16 inch minimum with no maximum especially at the corners which should be of small radius to make the opening almost square-cornered. In the second step the clubhead shadows are centered in the opening, the location of the sweet spots noted, and a circular simulated ball is placed in the opening connected above the location of the nominal sweet spot to the edge of the opening opposite the shadow of the clubhead's sole, that is to Item 2.

Referring to the figures the incomplete flat frame, which is the thin sheet the border of which surrounds the opening as defined above; the border consists of Items 1, 2, 3, and 4. Items 1 and 4 stand on their own as cantilever beams, and are of a width to render them easily bent. Item 3, adjacent to the tip of the clubhead, is of greater width so it will not respond to a blow on Item 2 by bending markedly. Item 1 is of considerable width as burying it in the ground so as to bring the side of the opening adjacent to the clubhead sole flush with the ground or simulated ground Item 9 holds the entire target structure in a vertical plane.

FIG. 3 shows the same elements as FIG. 2 with the addition of a doubler Item 8 which is added to the stamping for two reasons, to help Item 3 resist bending and twisting when Item 2 is struck and to stiffen Item 1 side of the incomplete flat frame so it can be more easily inserted in soft ground. Doubler 8 is securely attached to both Item 1 and Item 3, by spot welding in the preferred embodiment. FIG. 3 shows simulated ball Item 5 bent 90 degrees out of the plane of the incomplete flat frame, as would be done prior to use. A coloration and pattern on both sides of Item 5 render it a good simulation of a golf ball, as is necessary to keep use of the target as realistic as possible.

FIG. 4 shows a user's-eye view of the target from above. The simulated ball at which the user will swing the clubhead is prominent and the supporting structure relatively inconspicuous.

To adapt this invention to the wide range of golfers' skills so each skill level will be able to take advantage of it, the ¼ inch and 3/16 inch referred to in the first paragraph above will need to be increased. This will allow beginners to meet with success on early trials of hitting through the target, before they learn the stance and movements necessary to control the clubhead position at impact properly. Therefore, in the claims a range of ¼ inch to 2 inches is claimed for the excess of opening height and length beyond clubhead dimensions, corresponding to missing a perfect swing by ⅛ inch and 1 inch. Obviously, this error allowance includes differences in clubhead sizes and in sweet spot position with respect to the clubhead outline dimensions when the same target is used with a family of clubs.

FIG. 1 shows an entire apparatus for self-contained use, such as indoors. A low platform 6 provides a place for the user to stand. Item 6 may be solid or a ground simulation Item 9 supported on feet. Near one end is the target, shown as Items 2, 3, 4, and 5. Item 1, the wide side of the incomplete flat frame, is invisible in FIG. 1, being concealed in receiver slot 7 which is a simple slot provided in platform 6. Receiver slot 7 may have spring-loaded sides or be screw clamped to grasp Item 1 tightly, but the preferred embodiment is a narrow slot without embellishment, of a width to hold the target substantially vertical, and a depth such that the lower boundary of the opening is flush with, or slightly below, ground or simulated ground 9.

The material of the incomplete flat frame or target may be soft steel, aluminum, or copper as desired; soft aluminum being preferred. Resistance to work hardening is an important characteristic. The part may also be fabricated of an appropriate plastic such as polyethylene, provided it can be compounded sufficiently free of springback to make the bend required of the simulated ball. The doubler Item 8, if cemented in place, could be plastic.

A plastic version of FIG. 3 in which the preferred embodiment would be die cut from a flexible plastic extrusion is an alternate embodiment target, lacking the information to be gained from the bent target but having compensating advantages. These are the ability to change the thickness of the clubhead tip part of the incomplete flat frame (also designated as the border) Item 3, low cost production, the possibility of thermally reproducing a dimple pattern on the simulated ball, and reduced abrasion to the clubhead finish during improper strokes. The same extrusion could be used for left hand and right hand positions of the simulated ball 5, only the opening-cutting and frame-cutting dies would need to be reversed end for end (i.e., applied from the other side). An end view of the extrusion (also the finished target) is shown in FIG. 6, and a side view in FIG. 5.

Due to the widespread use of terms such as sole, sweet spot, shank, and tip in reference to golf clubheads, it is noted here only that the common understanding prevails. The sole of an iron is the flat area which, during a stroke, is adjacent to the ground, just as is the sole of a wood clubhead. Golfers each have their own customary stance, which refers to body position, including foot position, when a ball is addressed. The simulated golf ball referred to herein is a thin disc the diameter of a standard ball, marked and colored to appear to be the top view of an actual golf ball.

The invention having been described in the preferred and an alternate embodiment, it is clear that those skilled in the art can make modifications without exercise of the inventive faculty. Therefore, the scope of the invention is defined as that of the following claims:

I claim:

1. A target for a family of golf clubheads, comprising:

an incomplete flat frame of sheet metal having an opening rectangular on three sides—top, bottom and first end—with radiused corners, the fourth side or second end being angled outward at the maximum shaft angle with respect to the sole of a family of golf clubs, the distance between top and bottom sides of said rectangular opening being the greatest clubhead height of any club in the family plus a clearance distance of one-quarter to two inches, the length of the bottom side being the sum of distance from the sweet spot to the clubhead tip typical of the family plus the distance from the sweet spot to shank typical for the family measured along the clubhead sole plus a clearance distance, the second end being shorter than the first end and the top side of said incomplete flat frame merging with the first end and extending beyond the sweet spot but terminating short of the second end, these two truncated top and second end sides rendering said incomplete flat frame incomplete, and a mounting provision consisting of a broad bottom portion of said incomplete flat frame for insertion in the ground to the depth of the opening, holding the target in a vertical plane, and a simulated golf ball portion located in the opening and integral with the top side of the opening above the sweet spot, said simulated golf ball portion being marked to resemble the top view of a golf ball, whereby in use said simulated golf ball portion may be bent into a substantially horizontal position, the clubhead sweet spot directly under said simulated golf ball, passing through the target opening, any errors in clubhead position deduced from the bent areas of said incomplete flat frame, and the target straightened by the fingers for reuse.

2. Apparatus for practicing golf club strokes using the target of claim 1 and further comprising:

a low platform sufficiently extensive to support the golfers feet in the customary stance, and a slot on said low platform to receive said mounting provision on said target and hold it in a vertical position at an elevation such that the bottom of the opening is flush with the upper surface of said low platform.

3. A target for a family of golf clubheads, comprising:

a vertical plate member of plastic material containing a partially bordered opening rectangular on three sides—top, bottom and first end—with radiused corners, the fourth side or second end being angled outward at the maximum shaft angle with respect to the sole of a family of golf clubs, the distance between top and bottom sides of said rectangular opening being the greatest clubhead height of any club in the family plus a clearance distance of one-quarter to two inches, the length of the bottom side being the sum of distance from the sweet spot to the clubhead tip typical of the family plus the distance from the sweet spot to shank typical for the family measured along the clubhead sole plus a clearance distance, the second end being shorter than the first end and the top side of said vertical flat frame merging with the first end and extending beyond the sweet spot but terminating short of the second end, these two truncated top and second end sides providing an opening in the border for the golf club shaft, and a mounting provision consisting of increased width to the border at the bottom of the opening, and a simulated golf ball portion, the size and marking of a golf ball, extending horizontally from the border adjacent the top of the opening directly above the sweet spot, whereby a club from the family can be swung with its head passing through the opening below said simulated golf ball provided the head position during the stroke does not deviate from perfection by more than half the clearance distance.

4. Apparatus for practicing golf club strokes using the target of claim 3 and further comprising:

a low platform sufficiently extensive to support the golfer's feet in the customary stance, and a slot on said low platform to receive said mounting provision on said target and hold it in a vertical position at an elevation such that the bottom of the opening is flush with the upper surface of said low platform.

* * * * *